United States Patent [19]

Ferrigni

[11] Patent Number: 4,493,487

[45] Date of Patent: Jan. 15, 1985

[54] INTERCHANGEABLE TILES PUZZLE

[76] Inventor: Donato Ferrigni, Via Giacosa 16, Settimo Torinese, Italy

[21] Appl. No.: 492,330

[22] Filed: May 6, 1983

[30] Foreign Application Priority Data

May 6, 1982 [IT] Italy ..... 53260/82[U]

[51] Int. Cl.[3] ..... A63F 9/08

[52] U.S. Cl. ..... 273/153 S; 40/490

[58] Field of Search ..... 273/153 S, 281, 148 A, 273/150; 40/109, 490

[56] References Cited

U.S. PATENT DOCUMENTS

| | | | |
|---|---|---|---|
| 436,052 | 9/1890 | Deming | 40/490 X |
| 2,066,238 | 12/1936 | Supina | 273/150 |
| 4,451,040 | 5/1984 | Ashley | 273/153 S |

FOREIGN PATENT DOCUMENTS

| | | | |
|---|---|---|---|
| 54886 | 6/1982 | European Pat. Off. | 273/153 S |

*Primary Examiner*—Anton O. Oechsle

*Attorney, Agent, or Firm*—Sughrue, Mion, Zinn, Macpeak and Seas

[57] ABSTRACT

A puzzle comprising a box having an open face and a base wall relative to which a plurality of support elements carrying tiles provided with identification means are movable, against the action of resilient biassing means. Stop means retain the uppermost tiles in correspondence with the open face of the box, while the uppermost tiles are movable onto the support elements of adjacent tiles the latter being pressed down against their biassing means in order to obtain configurations which are determined in dependence upon the identification means carried by the tiles.

2 Claims, 6 Drawing Figures

INTERCHANGEABLE TILES PUZZLE

The present invention relates to puzzles of the type in which a plurality of members provided with identification means are movable along predetermined paths from a disordered condition into configurations which are predetermined in dependence on the identification means.

The object of the present invention is to provide a puzzle of the type referred to above which, while having an extremely simple structure, can be used as a passtime which is diverting and, at the same time, intelligent and can easily be adapted to different degrees of difficulty.

The puzzle according to the invention comprises a substantially parallelepiped-shaped box having an open face and containing a plurality of support elements adjacent and movable away from the open face perpendicular thereto towards the base of the box, each independently of the others and against the action of respective resilient biassing means; at least one tile provided with identification means resting on each support element on that side thereof facing the open face of the box and parallel thereto, and stop means carried by the box for retaining the tiles, under the action of the said resilient biassing means, in correspondence with the open face of the box, allowing each tile to be moved into correspondence with the support element of one of the adjacent tiles when this support element is pressed towards the interior of the box.

A player uses the puzzle by making successive movements of the various tiles to dispose them in a predetermined logical order or in a predetermined configuration. The level of difficulty of the play may be varied according to the number of tiles associated with each support element. In the case of a single tile on each support element, the level of difficulty of the play will be very low and hence suitable for children, or for teaching purposes, while when there are more than three tiles on each support element the level of difficulty of the puzzle will be very high and hence it will be suitable for particularly expert players.

According to a first embodiment of the invention, the open face of the box is square and the support elements and their respective tiles are disposed in a matrix in rows parallel to the sides of the container. In this case, the support elements and the tiles are also square.

According to another embodiment of the invention, the open face of the box is rectangular and the support elements and their respective tiles are aligned in a single row, each tile carrying a representation of a card for the game of poker.

The invention will now be described in detail with reference to the appended drawings, provided purely by way of non-limiting example, in which.

Figure 1:
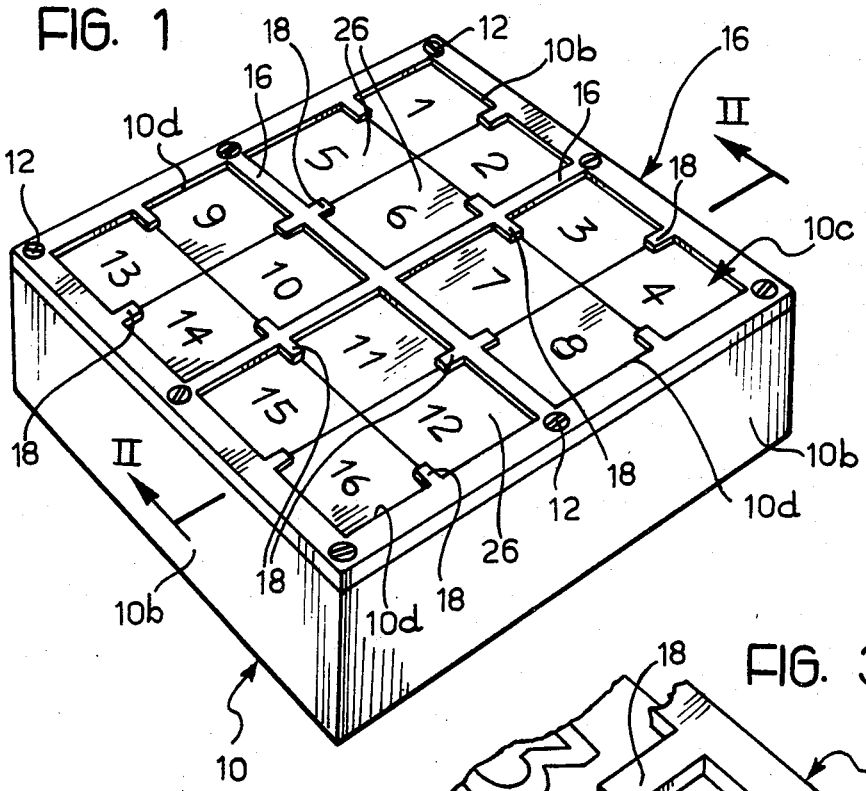
FIG. 1 is a perspective view of a puzzle according to a first preferred embodiment of the invention.
Figure 3:
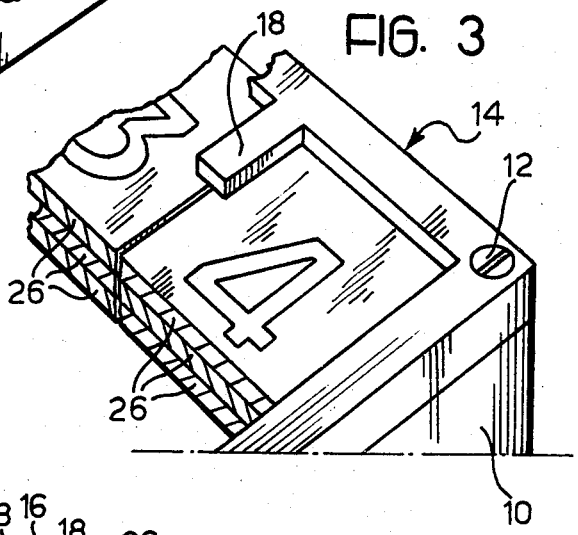
FIG. 3 is a perspective view on an enlarged scale of a detail of FIG. 1.
Figure 2:
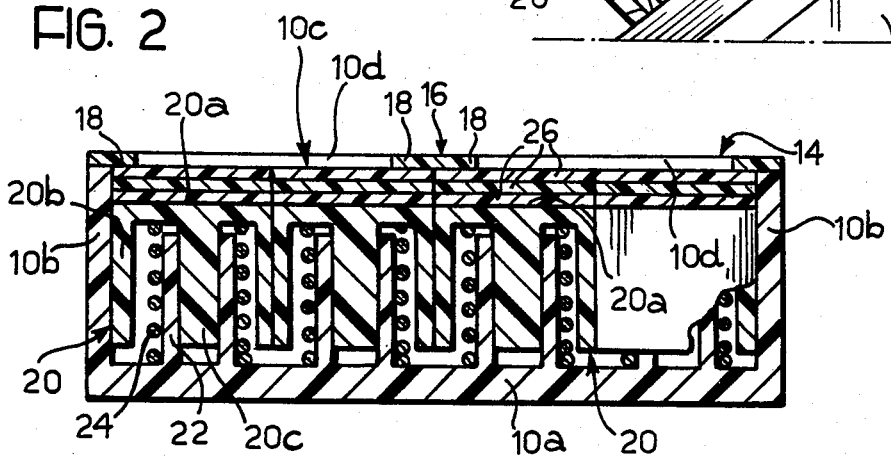
FIG. 2 is a transverse sectional view taken on line II—II of FIG. 1.

Referring initially to FIGS. 1 to 3, a parallelepiped shaped box indicated 10 has a square base wall 10*a*, four rectangular side walls 10*b* and an open upper face 10*c* which is also square. The box 10 may be of any suitable material such as, for example, wood or plastics.

To the edges of the side walls 10*b* opposite the base wall 10*a* there is fixed, for example by screws 12, a rigid frame 14 which surrounds the open face 10*c*. Two integral fillets 16 extend from the central zones of the sides of the frame 14 and intersect orthogonally, dividing the open face 10*c* into four equal areas 10*d* the sides of which are parallel to the sides of the frame 14. From the central zones of the sides of each area 10*d*, that is, from the central zones of the corresponding parts of the fillets 16 and of the corresponding parts of the sides of the frame 14, four stops 18 project a short distance into the area 10*d*.

The box 10 houses sixteen adjacent support elements 20 located in four rows parallel to the side walls 10*b*. As is clearly seen in FIG. 1, four support elements 20 are thus associated with each area 10*d*.

Each of the support elements 20 has a substantially prismatic shape with an upper square wall 20*a* facing the open face 10*c*, and a peripheral square section skirt 20*b* and a central guide pin 20*c* projecting from the lower face of the wall 20*a* (FIG. 2).

The height of each support element 20 is less than the depth of the box 10 and the pin 20*c* is slidably engaged in a guide bush 22 projecting perpendicularly from the base wall 10*a* towards the open face 10*c*.

Between the base wall 10*a* and the internal face of the upper wall 20*a* of each support element 20 there are interposed respective biassing means each comprising a helical compression spring 24 which urges the support element 20 towards the open face 10*c*.

On the upper wall 20*a* of each support element 20 there rests a plurality of tiles 26 of a shape identical to that of the upper wall 20*a*. In the embodiment illustrated there are normally three tiles 26 resting on each support element 20. However, this number may vary from a minimum of one to a maximum of five according to the desired degree of difficulty of the puzzle.

Each of the tiles 26 carries on its upper surface its own identification sign, which in the embodiment illustrated is constituted by a number of between one and sixteen. The identification of the tiles 26 may, however, be achieved by means of letters of the alphabet, symbols, colours, graphical or other representations.

Preferably, the tiles 26 have slightly rounded or chamfered corners to prevent jamming with the adjacent tiles.

The tiles 26 adjacent the open face 10*c* of the box 10 are pressed by the springs 24 of the respective support elements 20 against corresponding stops constituted, for each area 10*d*, by the fillet portions 16 and the frame 14 defining the area and by the projecting stops 18. Hence, as is clearly seen in FIG. 1, each of the tiles 26 is held along two of its adjacent sides and along parts of the other two adjacent sides. This prevents the tiles 26 from escaping from the box 10 through the face 10*c* and keeps the tiles 26 adjacent the face 10*c* in a plane parallel thereto.

By virtue of this arrangement, the tiles 26 adjacent the open face 10*c* carried by each support element 20 may be moved into correspondence with one of the adjacent supports 20, in directions parallel to the sides of the frame 14, when the adjacent support 20 is pressed inwardly of the box 10, that is, towards the base wall 10*a* against the action of its biassing spring 24. This, in practice, allows the successive movement of the various tiles 26 from a disordered condition towards a configuration which is predetermined or ordered in a logical manner in dependence on the identification symbols of the tiles themselves. Thus, in the case of the embodiment illustrated, the player's object when using the puzzle is to arrange the numbered tiles 26 in the sequence one to sixteen. Obviously, the greater the number of tiles 26 associated with each support element 20 the greater is the degree of difficulty of the puzzle since this increases the number of possible combinations.

Figure 4:
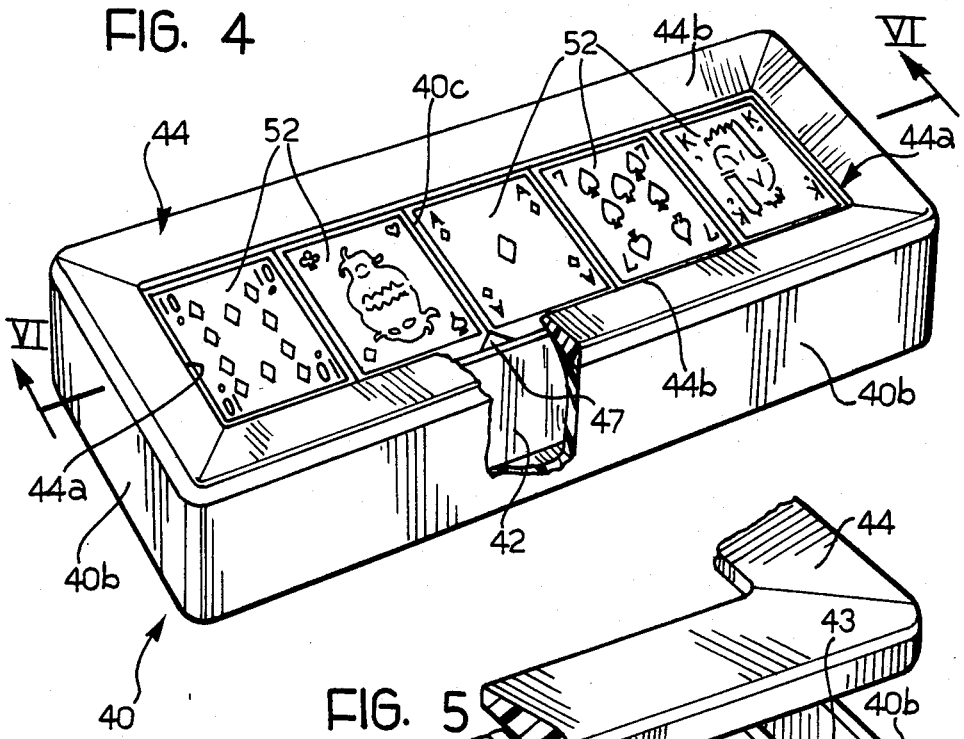
FIG. 4 is a perspective view of a puzzle according to a second preferred embodiment of the invention.
Figure 5:
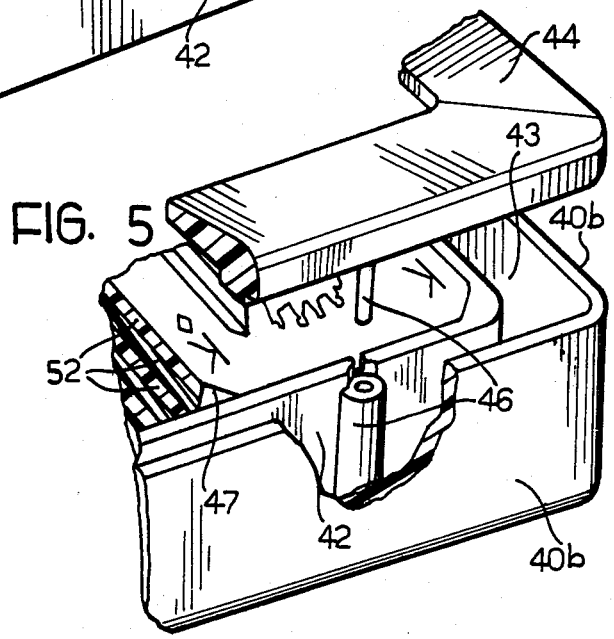
FIG. 5 is an exploded perspective view, on an enlarged scale, and partly broken-away of a part of FIG. 4.
Figure 6:
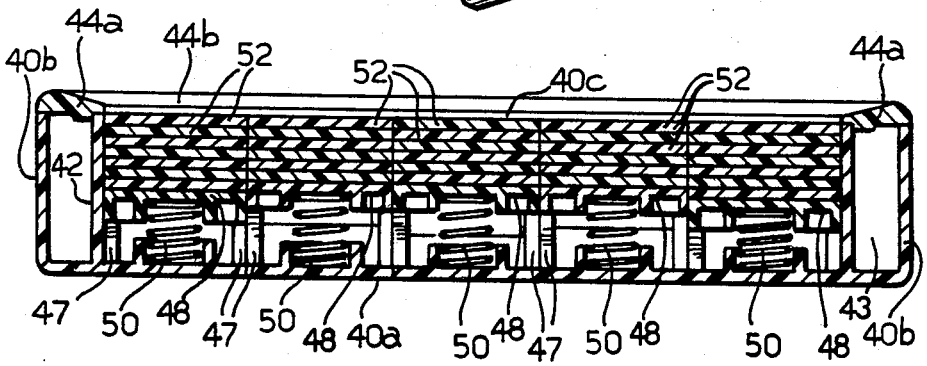
FIG. 6 is a cross-sectional view taken on the line VI—VI of FIG. 4.

Naturally the geometric form and the conformation of the box 10, the support elements 20 and the tiles 26 could be varied widely with respect to that described and illustrated in FIGS. 1–3: for example, one variant of the puzzle is illustrated in FIGS. 4 to 6, in which the box is indicated 40 and has a parallelepiped shape with a base wall 40*a* and a rectangular upper open face 40*c* and four side walls 40*b* which are also rectangular.

An inner wall, generally indicated 42, projects from the base wall 40*a* and has sides which are parallel to and spaced from the side walls 40*b* so as to define therewith an annular interspace 43.

A rigid frame 44 defining the open face 40*c* is attached to the upper edges of the walls 40*b* and 42, and is secured thereto by inter-engaging members 46, and possibly by gluing or welding. The shorter sides 44*a* of the frame 44 are flush with the corresponding sides of the wall 42 (FIG. 6) while the longer sides 44*b* of the frame 44 project inwardly from the longer side of the wall 42 into the open face 40*c* of the box 40.

On the inner faces of the longer sides of the wall 42 there are provided vertical guide projections 47 of trianglar cross-section between which five support elements 48 are movable vertically. Each support element 48 is biassed upwardly by a respective helical compression spring 50 which reacts against the base wall 40*a*, urging the element 48 towards the open face 40*c*. As in the preceding embodiment, a plurality of tiles 52 of rectangular shape rests on each support element 48, the tiles 52 extending between the longer sides of the wall 42. Hence the tiles 52 adjacent the open face 40*c* of the box 40 are pressed by respective springs 50 against the projecting edges of the longer sides 44*b* of the frame 44 which prevents the tiles 52 from escaping from the box and allows the tiles 52 adjacent the face 40*c* to be kept in a plane parallel thereto.

Each of the tiles 52 has on its upper face its own identification sign which in this case is formed by a representation of a playing card for the game of poker. There are the same number of tiles 52 as the number of cards normally necessary for this game, that is, thirty two, and these are normally distributed so that there are seven tiles 52 in correspondence with each of the support elements 48 located at the ends of the box 40 and six tiles 52 in correspondence with the three intermediate support elements 48.

By virtue of this arrangement the tiles 52 adjacent the open face 40*c* carried by each support element 48 may be moved into correspondence with one of the adjacent support elements 48 in directions parallel to the longer sides of the box 40, by pressing the adjacent support element 48 inwardly towards the base wall 40*a* of the box against the action of the respective biassing spring 50. Thus the tiles 52 may be moved successively so that those located in correspondence with the open face 40*c* assume arrangements or combinations corresponding to the game of poker.

In order to make the puzzle even more entertaining, the faces of the support elements 48 facing the open face 40*c* may be provided with representations of jokers.

In an alternative embodiment the tiles 52 may be provided with symbols of the type used in slot machines, or even with simple areas of different colours.

I claim:

1. Puzzle of the type in which a plurality of members provided with identification means are moveable along predetermined paths from a disordered configuration into a configuration which is predetermined in dependence upon the identification means, wherein the puzzle comprises:

a substantially parallelepiped shaped box having a base wall and side walls bounding an open face;

a plurality of support elements housed within the box and moveable individually away from the open face perpendicular to the base wall;

respective resilient biasing means acting upon the support elements and urging them away from the base wall;

at least one tile provided with said identification means resting on each support element on that side thereof facing the open face of the box, and parallel thereto, and stop means carried by the box for retaining the tiles against the action of the said resilient biasing means, so that the uppermost tiles are disposed in correspondence with the open face of the box, while the resilient biasing means allow each tile to be moved into correspondence with the support element of one of the adjacent tiles when said support element is pressed towards the base wall of the box;

wherein the open face of the box, the supportive elements and the tiles are square and the support elements and their respective tiles are disposed in a matrix in rows parallel to the sides of the box; and wherein there are sixteen support elements and the retaining means include a frame attached to the side walls bounding the open face of the box, a pair of fillets which are perpendicular to each other and which extend from the central zones of the sides of the frame across the open face, dividing the latter into four sections each of which is associated with a group of four support elements, and a series of stops projecting from the frame and from the said fillets into each said section, so that each of the tiles adjacent the open face is held against the retaining means under the action of the springs acting on the support elements, along two of its adjacent sides and along parts of the other of its two adjacent sides.

2. Puzzle of the type in which a plurality of members provided with identification means are moveable along predetermined paths from a disordered configuration into a configuration which is predetermined in dependence upon the identification means, wherein the puzzle comprises:

a substantially parallelepiped shaped box having a base wall and side walls bounding an open face;

a plurality of support elements housed within the box and moveable individually away from the open face perpendicular to the base wall;

respective resilient biasing means acting upon the support elements and urging them away from the base wall;

at least one tile provided with said identification means resting on each support element on that side thereof facing the open face of the box, and parallel thereto, and stop means carried by the box for retaining the tiles against the action of the said resilient biasing means, so that the uppermost tiles are disposed in correspondence with the open face of the box, while the resilient biasing means allow each tile to be moved into correspondence with the support element of one of the adjacent tiles when said support element is pressed towards the base wall of the box;

wherein the open face of the box is rectangular and the box contains a single row of support elements and respective tiles; and wherein the stop means comprise a frame attached to the edge of the side walls of the box and having two major sides projecting into the open face of the box to retain the tiles.

* * * * *